US006103394A

United States Patent [19]

Okuda et al.

[11] Patent Number: 6,103,394

[45] Date of Patent: Aug. 15, 2000

[54] THIN STEEL SHEET HAVING EXCELLENT RECTANGULAR DRAWABILITY AND PRODUCTION METHOD THEREOF

[75] Inventors: Kaneharu Okuda; Yoshikazu Kawabata; Kei Sakata; Takaaki Hira; Atsushi Ogino; Takashi Obara, all of Chiba, Japan

[73] Assignee: Kawasaki Steel Corporation, Hyogo, Japan

[21] Appl. No.: 09/029,716

[22] PCT Filed: Nov. 27, 1997

[86] PCT No.: PCT/JP97/04336

§ 371 Date: Mar. 3, 1998

§ 102(e) Date: Mar. 3, 1998

[87] PCT Pub. No.: WO98/28457

PCT Pub. Date: Jul. 2, 1998

[30] Foreign Application Priority Data

Dec. 24, 1996 [JP] Japan ..... 8-343449
Aug. 26, 1997 [JP] Japan ..... 9-229580

[51] Int. Cl.[7] ..... B21C 1/00; C21D 9/00

[52] U.S. Cl. ..... 428/577; 148/503; 148/579; 148/651; 148/320

[58] Field of Search ..... 428/577; 148/500, 148/503, 507, 564, 579, 651, 662, 320; 420/902

[56] References Cited

U.S. PATENT DOCUMENTS 4,973,367 11/1990 Matsuoka et al. ..... 148/503

FOREIGN PATENT DOCUMENTS 56-62926 5/1981 Japan .
57-19330 2/1982 Japan .
63-86819 4/1988 Japan .
63-290223 11/1988 Japan .

*Primary Examiner*—Deborah Jones
*Assistant Examiner*—Robert R. Koehler
*Attorney, Agent, or Firm*—Young & Thompson

[57] ABSTRACT

A thin steel sheet having excellent rectangular drawability is produced by completing roughing rolling of steel containing C: 0.02 wt % or less, Si: 0.5 wt % or less, Mn: 1.0 wt % or less, P: 0.15 wt % or less, S: 0.02 wt % or less, Al: 0.01 to 0.10 wt %, N: 0.008 wt % or less, at least one of Ti: 0.001 to 0.20 wt % and Nb: 0.001 to 0.15 wt %, the balance comprising Fe, and inevitable impurities, in the temperature region of 950° C. to the $Ar_3$ transformation temperature: performing finish rolling at a reduction of over 70% under lubrication in the temperature region of the $Ar_3$ transformation temperature to 500° C.; pickling the sheet; annealing the resultant hot rolled sheet under conditions which satisfy the equations (1) and (2) below:

$$(T+273)\ (20+\log t) \geqq 2.50\times10^4 \quad (1)$$

$$745 \leqq T \leqq 920 \quad (2)$$

wherein T: hot rolled sheet annealing temperature (° C.)

t: hot rolled sheet annealing time (sec); cold rolling at a reduction of 50 to 95%; and then recrystallization annealing; to satisfy the following relations:

$$(r_L+r_C)/2-r_D \geqq 0.67, \text{ and}$$

$$(r_L+2r_D+r_C)/4 \geqq 2.7,$$

wherein $r_L$: Lankford value in the rolling direction, $r_D$: Lankford value in the direction at 45° with the rolling direction, and $r_C$: Lankford value in the direction perpendicular to the rolling direction.

14 Claims, 6 Drawing Sheets

THIN STEEL SHEET HAVING EXCELLENT RECTANGULAR DRAWABILITY AND PRODUCTION METHOD THEREOF

TECHNICAL FIELD

The present invention relates to a thin steel sheet having excellent rectangular drawability and being suitable for use in forming rectangular parts such as an automobile oil pan, etc., and a production method and a method of application thereof.

BACKGROUND ART

A deep drawing steel sheet is conventionally used for forming in which the height of press forming is high, or the shape is complicated, for example, forming automobile components such as an oil pan, etc. As a mechanical property required for this deep drawing steel sheet, it is necessary that the r value (Lankford value, abbreviated to "the r value" hereinafter), particularly the average r value ($(r_L+2r_D+r_C)/4$ wherein $r_L$, $r_D$ and $r_C$ indicate r values in the rolling direction, the direction at 45° with the rolling direction and the direction perpendicular to the rolling direction, respectively), is high. It has been considered that when the planar anisotropy of r values $\Delta r=(r_L+r_C)/2-r_D$ is low, uniform drawing is possible with high yield. It has also been considered that an effective manner of increasing the r value was to decrease $\Delta r$.

Therefore, conventional development of materials has progressed from this viewpoint, and a lot of effort has been made for this purpose. For example, a cold-rolled steel sheet comprising extra low-C steel ($C \leqq 0.008$ wt %) to which a carbide forming element such as Ti, Nb or the like is added has been developed. Further, the technique of obtaining a higher r value, e.g., an average r value of 2.6 or more, by warm lubrication rolling of the extra low-C steel has recently been proposed in, for example, Japanese Patent Unexamined Publication Nos. 64-28325 and 2-47222.

However, even for such a steel sheet having an ultra-high r value, actual rectangular drawing sometimes causes breakage during press forming. "Rectangular drawing" means such asymmetrical drawing deformation as shown in FIG. 3, unlike axially symmetric cupping. In order to avoid such breakage, an attempt has been conventionally made to simply increase the average r value or decrease $\Delta r$ on the basis of the thinking that the breakage is due to an insufficient r value, and a lot of effort has been made to further improve the steel sheet production process. However, the breakage cannot be effectively prevented yet.

In detailed examination of such breakage portions, not only $\alpha$ breakage (breakage from a punch shoulder), which is often observed in a normal deep drawability test (cup forming), but also wall breakage, i.e., breakage from an intermediate position of the corner wall, often occur. Such types of breakage do not occur as often in cupping, and can be said to be peculiar to rectangular forming.

There are few researches on wall breakage in rectangular forming, and it is known from, for example, "Plasticity and Working", Vol. 10, No. 101 (1969-6), P. 425, that the occurrence of wall breakage tends to be suppressed by increasing strength and T value (thickness strain at the time of occurrence of breakage in pure bulging), or decreasing the crystal grain diameter.

However, components such as an oil pan and the like which have a high height of forming are required to have high average r values, and thus have a problem in that it is difficult from the viewpoint of mechanical properties to satisfy a high r value, and high strength and a fine grain diameter, which cause a decrease in the r value. With respect to the T value, there is a problem in that no effective means for increasing the T value is known.

As described above, the fact is that since there are few researches on mechanical properties in such forming as rectangular forming, what factors of a steel sheet affect the wall breakage which occur in rectangular forming have been hardly known yet. Under these conditions, in fact, a steel sheet having mechanical properties suitable for rectangular forming or a production method thereof are hardly investigated.

SUMMARY OF THE INVENTION

Accordingly, an object of the present invention is to provide a thin steel sheet which has excellent rectangular drawability, particularly a thin steel sheet in which the occurrence of wall breakage in rectangular drawing is suppressed, and a production method thereof.

Another object of the present invention is to provide a method of application of a steel sheet which produces no breakage in drawing into a rectangular shape having various plane shapes (the shape of a formed product in a plan view) using the steel sheet, and which is suitable for such shapes.

The inventors first carried out study on mechanical properties required for suppressing wall breakage in rectangular forming. As a result, it was found through trial and error that in order to prevent wall breakage in rectangular forming, it is advantageous to increase the planar anisotropy of r values including $\Delta r$ in a sheet surface to some extent while maintaining a high average r value. Also specified conditions for the r value in the direction of each of the sheet surfaces required for obtaining good rectangular drawability, particularly conditions for permitting good rectangular drawing even when the plane shape of a rectangular shape is changed due to the relation to the rolling direction, could be determined.

Further, in order to maintain the planar anisotropy of the r values without decreasing the average r value, production conditions, particularly conditions for warm rolling under lubrication, and base sheet annealing for annealing a hot rolled sheet, are significantly important.

The present invention has been achieved on the basis of these findings, and the gist and construction of the invention are as follows.

Disclosure of the Invention (1) A thin steel sheet having excellent rectangular drawability wherein the Lankford value in each of the directions of the steel sheet satisfies the following relational equations:

$$(r_L+r_C)/2-r_D \geqq 0.67, \text{ and}$$

$$(r_L+2r_D+r_C)/4 \geqq 2.7$$

wherein:

$r_L$: Lankford value in the rolling direction $r_D$: Lankford value in the direction at 45° with the rolling direction $r_C$: Lankford value in the direction perpendicular to the rolling direction.

(2) A thin steel sheet having excellent rectangular drawability wherein the Lankford value in each of the directions of the steel sheet satisfies the following relational equations:

$$(r_L+r_C)/2-r_D \geqq 0.67; \text{ and}$$

$$(r_L+2r_D+r_C)/4 \geqq 2.7;$$

and at least one of the following relations:

$$r_C - r_D \geqq 0.3 \text{ and } r_L - r_D \geqq 0.3$$

wherein:

$r_L$: Lankford value in the rolling direction $r_D$: Lankford value in the direction at 45° with the rolling direction $r_C$: Lankford value in the direction perpendicular to the rolling direction.

(3) The thin steel sheet (1) or (2) containing 0.02 wt % or less of C.

(4) The thin steel sheet (1) or (2) comprising the following composition:

| | |
|---|---|
| C: 0.02 wt % or less; | Si: 0.5 wt % or less; |
| Mn: 1.0 wt % or less; | P: 0.15 wt % or less; |
| S: 0.02 wt % or less; | Al: 0.01 to 0.10 wt %; |
| N: 0.008 wt % or less; | |
| at least one of Ti: 0.001 to 0.20 wt % and Nb: 0.001 to 0.15 wt %; | |
| the balance comprising Fe; and | |
| inevitable impurities. | |

(5) The thin steel sheet (1) or (2) comprising the following composition:

| | |
|---|---|
| C: 0.02 wt % or less; | Si: 0.5 wt % or less; |
| Mn: 1.0 wt % or less; | P: 0.15 wt % or less; |
| S: 0.02 wt % or less; | Al: 0.01 to 0.10 wt %; |
| N: 0.008 wt % or less; | |
| at least one of Ti: 0.001 to 0.20 wt % and Nb: 0.001 to 0.15 wt %; | |
| B: 0.0001 to 0.01 wt %; | |
| the balance comprising Fe; and | |
| inevitable impurities. | |

(6) The thin steel sheet (1) or (2) comprising the following composition:

| | |
|---|---|
| C: 0.02 wt % or less; | Si: 0.5 wt % or less; |
| Mn: 1.0 wt % or less; | P: 0.15 wt % or less; |
| S: 0.02 wt % or less; | Al: 0.01 to 0.10 wt %; |
| N: 0.008 wt % or less; | |
| at least one of Ti: 0.001 to 0.20 wt % and Nb: 0.001 to 0.15 wt %; | |
| at least on of Sb: 0.001 to 0.05 wt %, Bi: 0.001 to 0.05 wt %, and Se: 0.001 to 0.05 wt %; | |
| the balance comprising Fe; and | |
| inevitable impurities. | |

(7) The thin steel sheet (1) or (2) comprising the following composition:

| | |
|---|---|
| C: 0.02 wt % or less; | Si: 0.5 wt % or less; |
| Mn: 1.0 wt % or less; | P: 0.15 wt % or less; |
| S: 0.02 wt % or less; | Al: 0.01 to 0.10 wt %; |
| N: 0.008 wt % or less; | |
| at least one of Ti: 0.001 to 0.20 wt % and Nb: 0.001 to 0.15 wt %; | |
| B: 0.0001 to 0.01 wt %; | |
| at least one of Sb: 0.001 to 0.05 wt %, Bi: 0.001 to 0.05 wt %, and Se: 0.001 to 0.05 wt %; | |
| the balance comprising Fe; and | |
| inevitable impurities. | |

(8) Any one of the thin steel sheets (4) to (7) wherein the contents of C, N, S, Ti and Nb satisfy the following relation:

$$1.2(C/12+N/14+S/32)<(Ti/48+Nb/93).$$

(9) A process for producing a thin steel sheet having excellent rectangular drawability, comprising completing rough rolling of steel comprising the following composition in the temperature region of 950° C. to the $Ar_3$ transformation temperature:

| | |
|---|---|
| C: 0.02 wt % or less; | Si: 0.5 wt % or less; |
| Mn: 1.0 wt % or less; | P: 0.15 wt % or less; |
| S: 0.02 wt % or less; | Al: 0.01 to 0.10 wt %; |
| N: 0.008 wt % or less; | |
| at least one of Ti: 0.001 to 0.20 wt % and Nb: 0.001 to 0.15 wt %; | |
| the balance comprising Fe; and | |
| inevitable impurities. | |

performing finishing rolling at a reduction of over 70% under lubrication in the temperature region of the $Ar_3$ transformation temperature to 500° C., pickling the steel, performing base sheet annealing of the resultant base sheet under conditions which satisfy the equations (1) and (2) below, cold rolling at a reduction of 50 to 95%, and then recrystallization annealing.

$$(T+273)(20+\log t) \geqq 2.50\times10^4 \quad (1)$$

$$745 \leqq T \leqq 920 \quad (2)$$

wherein:

T: hot rolled sheet annealing temperature (° C.)

t: hot rolled sheet annealing time (sec)

(10) The process for producing a thin steel sheet (9) wherein the steel composition further comprises:

B: 0.0001 to 0.01 wt %.

(11) The process for producing a thin steel sheet (9) or (10) wherein the steel composition further comprises:

at least one of Sb: 0.001 to 0.05 wt %, Bi: 0.001 to 0.05 wt %, and Se: 0.001 to 0.05 wt %.

(12) Any one of the processes for producing a thin steel sheet (9) to (11) wherein the contents of C, N, S, Ti and Nb satisfy the following relation:

$$1.2(C/12+N/14+S/32)>(Ti/48+Nb/93).$$

(13) A method of application of a thin steel sheet wherein in rectangular drawing using a thin steel sheet, a rectangular plane shape and the Lankford values of the thin steel sheet are adjusted to satisfy the following equations:

$$(r_L+r_C)/2-r_D \geqq 0.67; \text{ and}$$

$$(r_L+2r_D+r_C)/\geqq 2.7;$$

when $L_L \geqq L_C$, $$r_C - r_D \geqq 0.3; \text{ and}$$

$$r_L - r_D \geqq 0.4-0.1(L_L/L_C)^2; \text{ and}$$

when $L_L < L_C$, $$r_L - r_D \geqq 0.3, \text{ and}$$

$$r_C - r_D > 0.4 - 0.1(L_C/L_L)^2,$$

wherein:

$L_L$: length of a straight side of a rectangular shape in the rolling direction $L_C$: length of a straight side of a rectangular shape in the direction perpendicular to the rolling direction $r_L$: Lankford value in the rolling direction $r_D$: Lankford value in the direction at 45° with the rolling direction $r_C$: Lankford value in the direction perpendicular to the rolling direction.

(14) A method of forming a thin steel sheet wherein in rectangular drawing using a thin steel steel sheet, a rectangular plane shape and the Lankford values of the thin steel sheet are adjusted to satisfy the following equations:

$$(r_L + r_C)/2 - r_D > 0.67; \text{ and}$$

$$(r_L + 2r_D + r_C)/4 \geqq 2.7;$$

when $L_L \geqq L_C$, $$r_C - r_D \geqq 0.3; \text{ and}$$

$$r_L - r_D > 0.4 - 0.1(L_L/L_C)^2; \text{ and}$$

when $L_L < L_C$, $$r_L - r_D \geqq 0.3; \text{ and}$$

$$r_C - r_D \geqq 0.4 - 0.1(L_C/L_L)^2;$$

wherein:

$L_L$: length of a straight side of a rectangular shape in the rolling direction $L_C$: length of a straight side of a rectangular shape in the direction perpendicular to the rolling direction $r_L$: Lankford value in the rolling direction $r_D$: Lankford value in the direction at 45° with the rolling direction $r_C$: Lankford value in the direction perpendicular to the rolling direction.

BRIEF DESCRIPTION OF THE DRAWINGS

FIG. 9 is a drawing showing the definition of the length of a straight side.

BEST MODE FOR CARRYING OUT THE INVENTION

The present invention will be described in detail below.

The inventors performed examination on the mechanism of occurrence of wall breakage in rectangular drawing. As a result, the inventors found the following:

(1) A steel sheet which easily produces wall breakage has the tendency that a corner flange hardly flows into the wall.

(2) The flow of the corner flange into the wall increases with decreases in the r value (referred to as "$r_T$") of the corner in the inflow direction comparing to the r value (referred to as "$r_S$") of a straight side in the inflow direction. Here, $r_S$ represents the average r value of both straight sides, which hold the corner therebetween, in the inflow direction.

Figure 1:
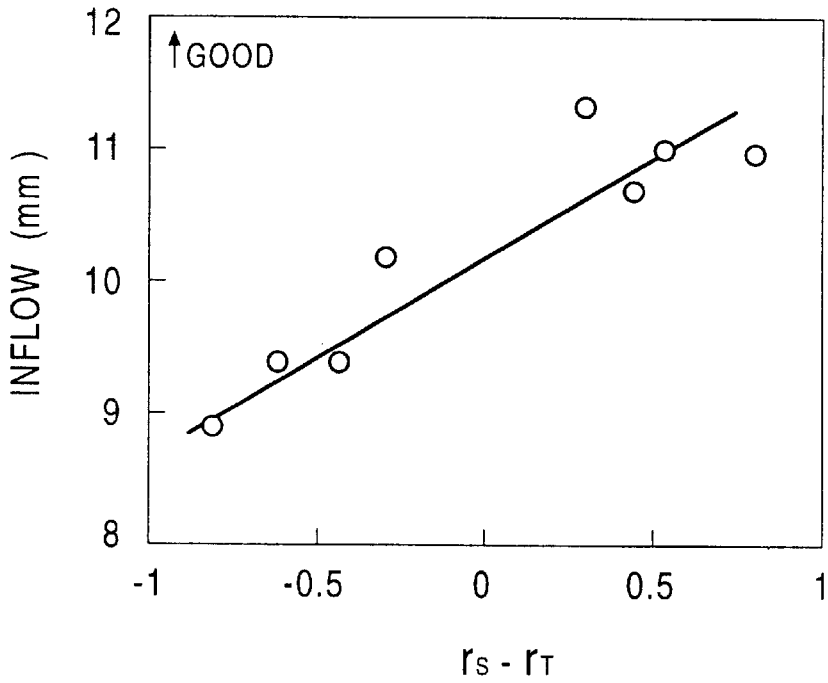
FIG. 1 is a graph showing influences of a difference between the r value of a straight side of a corner flange and the r value of a corner thereof on the flow into the wall in rectangular drawing.

First experiment from which the results shown in FIG. 1 were obtained will be described.

Rectangular test pieces each having a side of 88 mm were obtained from a steel sheet showing various r values and having a thickness of 1.2 mm in various blanking directions so that the diagonal directions thereof are 0 and 45° with the rolling direction. After rustproofing oil was coated to each of the test pieces, the test piece was set in a direction in which the corners of the test piece agreed with the corners of a square punch, followed by drawing to a forming height of 30 mm under a blank holder pressure of 4 ton for preventing wrinkles. The punch had a 40-mm square shape having side R of 10 mm and punch shoulder R of 5 mm. The diagonal length of a flange was measured before and after drawing, and the flow of the flange into the wall was determined by subtracting the diagonal length of the test piece after drawing from the diagonal length thereof before drawing, and then dividing the obtained value by 2.

As described above in (2), although the mechanism of influences of the r values of the corners and the straight sides on the flow of the corner flange into the wall is not necessarily apparent, the inventors consider the mechanism as described below.

Figure 2:
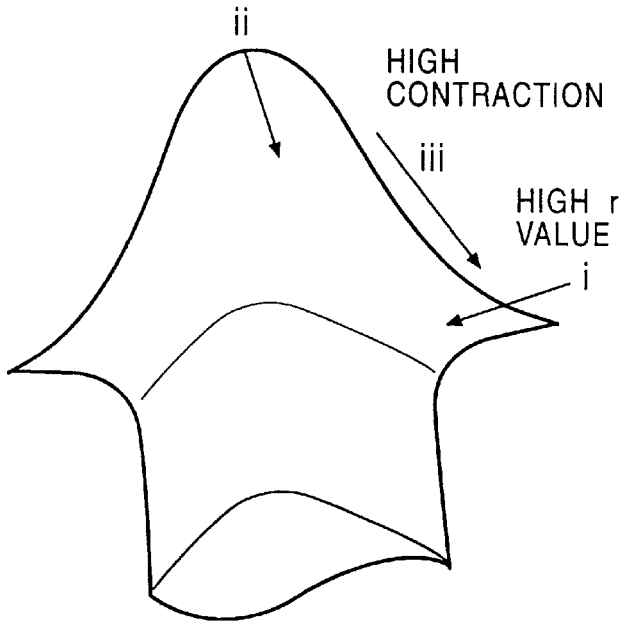
FIG. 2 is a schematic drawing illustrating the mechanism of influences of the r values of a corner and a straight side of a corner flange on the flow into the wall.

In rectangular drawing, since the drawing ratio of a corner is very high, it is difficult to flow the corner flange only by drawing the corner wall, and it is necessary for a flange of a straight side to have the function to draw the corner flange. Therefore, as schematically shown in FIG. 2, it is considered effective that the r value of a straight side of the steel sheet in the inflow direction (direction i shown in the drawing) is higher than the r value of a corner in the inflow direction (direction ii shown in the drawing). In this case, the flange of the straight side is significantly contracted in direction iii during drawing, and thus the corner flange can be drawn in the direction ii.

In any case, in order to prevent wall breakage in rectangular drawing, it was found to be effective that the r value ($r_T$) of a corner in the inflow direction is smaller than the r value ($r_S$) of a straight side in the inflow direction. In FIG. 1, the average r value of the straight sides, which fold a corner therebetween, in the inflow direction is used as $r_S$. However, in order to suppress wall breakage, of course, it is necessary that the r values of both straight sides, which hold the corner therebetween, are high.

Even in rectangular drawing, a decrease in the average r value causes the above-mentioned breakage in the punch shoulder at a corner, i.e., "α breakage". Therefore, it is necessary for a steel sheet used for rectangular drawing to have a high average r value.

Figure 3:
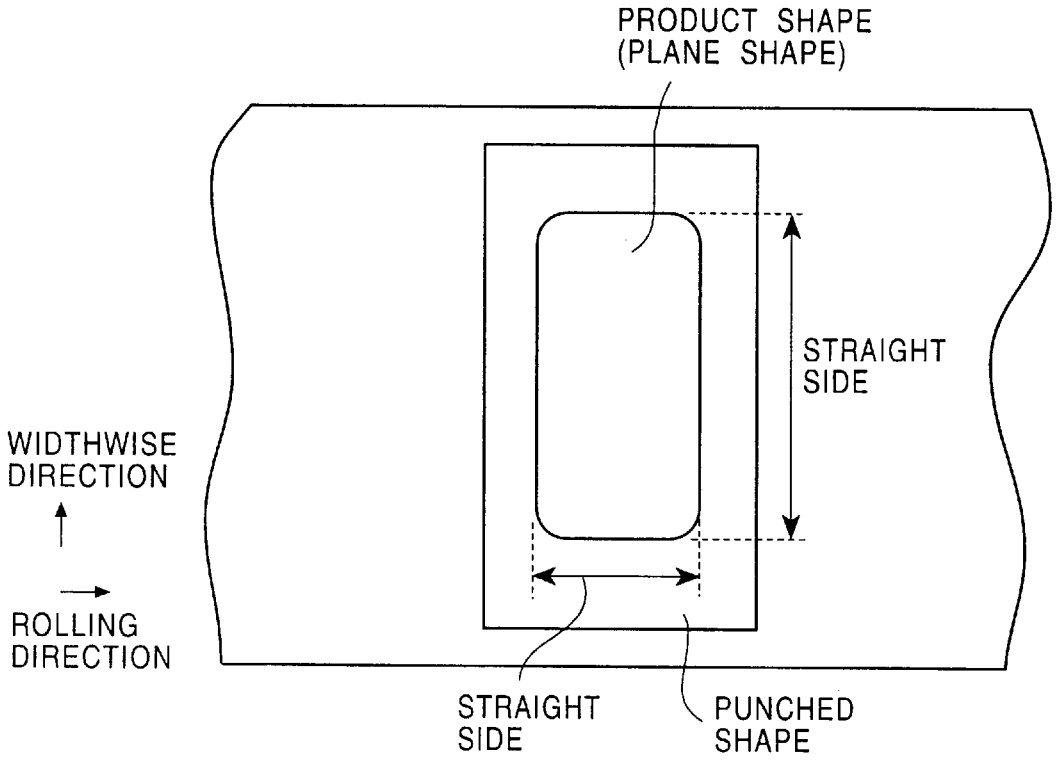
FIG. 3 is a schematic drawing showing punching of a rectangular original plate for press forming from a steel strip.

Generally, when an original sheet for a rectangular product is punched from a steel strip, in consideration of the yield of the steel sheet, punching is carried out as shown in FIG. 3. In this punching, the inflow direction of a corner of a rectangular shape agrees with the direction at 45° with the rolling direction, and the inflow direction of a straight side agrees with the rolling direction or the direction perpendicular to the rolling direction.

Therefore, according to the above-described knowledge, a steel sheet having high anisotropy of r values $\Delta r=(r_L+r_C)/2-r_D$ and a high average r value$=(r_L+2rD+r_C)/4$ has excellent rectangular drawability.

Accordingly, the inventors performed further research on a production method using a steel sheet having high r values as a base in order to obtain a steel sheet having a high value of $(r_L+r_C)/2-r_D$. The results obtained are shown in FIGS. 4 to 8.

Figure 4:
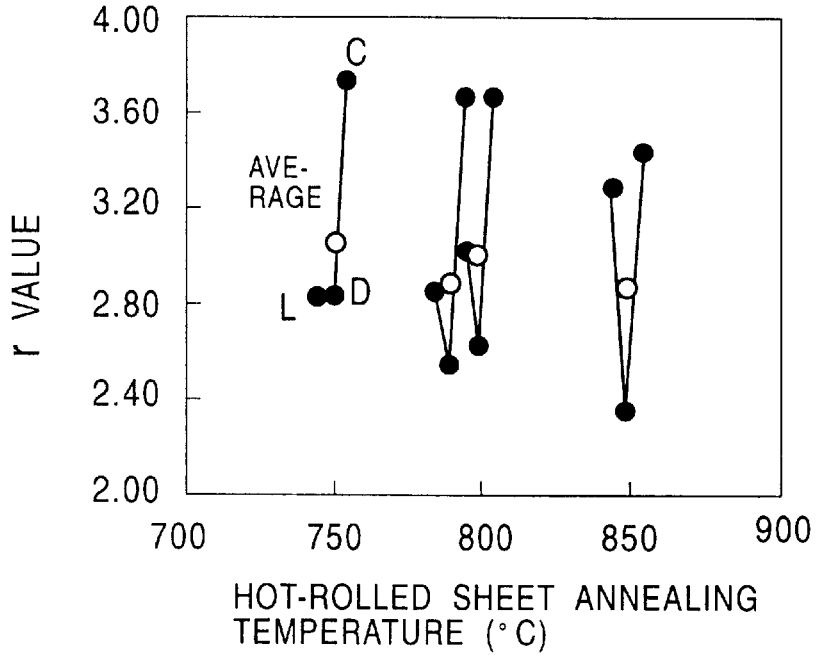
FIG. 4 is a graph showing influences of the hot rolled sheet annealing temperature on the r value in each direction.
Figure 5:
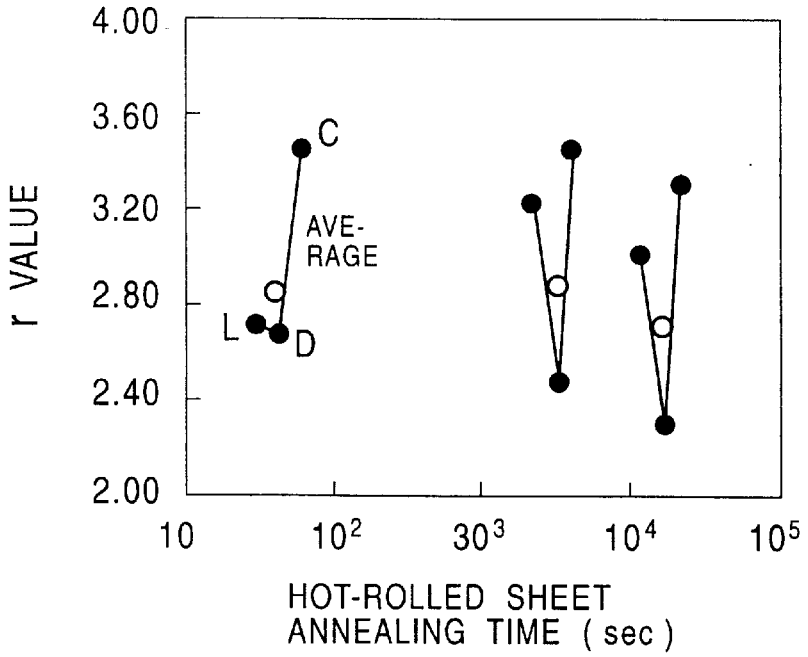
FIG. 5 is a graph showing influences of the hot rolled sheet annealing time on the r value in each direction.

FIGS. 4 and 5 show the relations between hot rolled sheet annealing conditions and the r value in each direction of the steel sheet. These drawings indicate that as the hot rolled sheet annealing temperature increases, or the hot rolled sheet annealing time increases, $r_D$ decreases, while $r_L$ increases. It is also found that since $r_C$ hardly changes, $r_L-r_D$, $r_C-r_D$ and $(r_L+r_C)/2-r_D$ increase, and $(r_L+2r_D+r_C)/4$ also increases.

Figure 6:
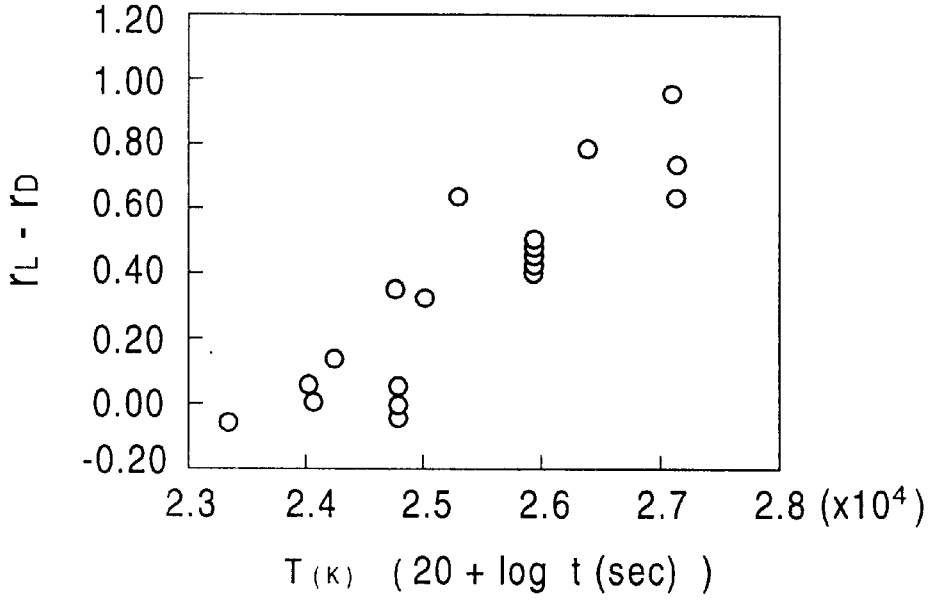
FIG. 6 is a graph showing the relation between $r_L - r_D$ and T (unit K) (20 +log t (unit sec)).
Figure 7:
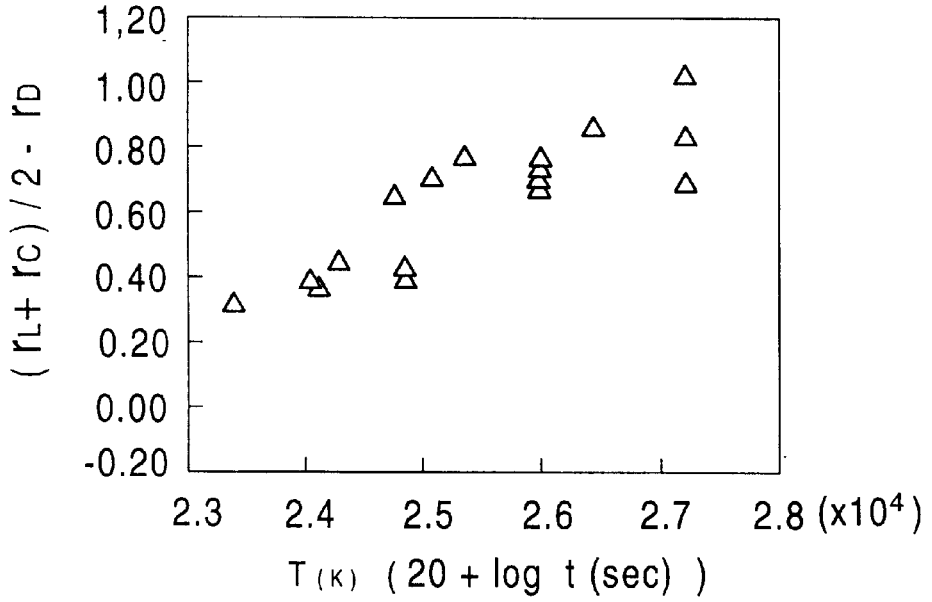
FIG. 7 is a graph showing the relation between $(r_L + r_C)$ $2 - r_D$ and T (unit K) (20 +log t (unit sec)).

As shown in FIGS. 6 and 7, $r_L-r_D$ and $(r_L+r_C)/2-r_D$ can be arranged by using (T+273)(20 +log t) which is a function of the hot rolled sheet annealing temperature T (C) and the hot rolled sheet annealing time t (sec), and it was found that when $(T+273)(20+\log t)\geqq 2.50\times 10^4$, $r_L-r_D\geqq 0.3$ and $(r_L+r_C)/2-r_D\geqq 0.67$. At this time, $r_C-r_D\geqq 0.3$ and $(r_L+2r_D+r_C)/4\geqq 2.7$ were also satisfied.

FIG. 4 shows the results of rearrangement of data of Nos. 1, 4 and 7 in the example shown in Table 2 which will be described below, FIG. 5 shows the results of rearrangement of data of Nos. 8, 12 and 16 shown in Table 2, and FIGS. 6 and 7 show the results of rearrangement of data except data of Nos. 18, 24, 25, 26, 29 and 30 shown in Table 2 in which the chemical components and hot-rolling conditions do not satisfy the production conditions of the present invention. In all steel samples, the reduction at $Ar_3$ to 500° C. is 80% or more.

Although the mechanism of influence of the hot rolled sheet annealing temperature on the r values of a cold-rolled and annealed steel sheet is not necessarily apparent, the inventors consider the mechanism as follows.

As the hot rolled sheet annealing temperature increases, or the hot rolled sheet annealing time increases, the ferrite grain diameter increases, a carbide and/or nitride is made spherical, and the distribution thereof is made coarse. These factors change the amount of accumulation and the distribution of strain in cold rolling, thereby slightly developing the {211} texture in addition to the {111} texture after finish annealing. As a result, the above-described r values are possibly obtained.

It is necessary that the hot rolled sheet annealing temperature satisfies the condition (T+273) (20 +log t) and, at the same time, the conditions of 745° C. or more and 920° C. or less. This is because at a hot rolled sheet annealing temperature exceeding 920° C., the crystal grain becomes excessively coarse, thereby causing the problems of roughing the surface in subsequent cold rolling and decreasing the r values due to nonuniformity of strain in cold rolling. On the other hand, at a hot rolled sheet annealing temperature of less than 745° C., the required annealing time uneconomically exceeds 10 hr.

Figure 8:
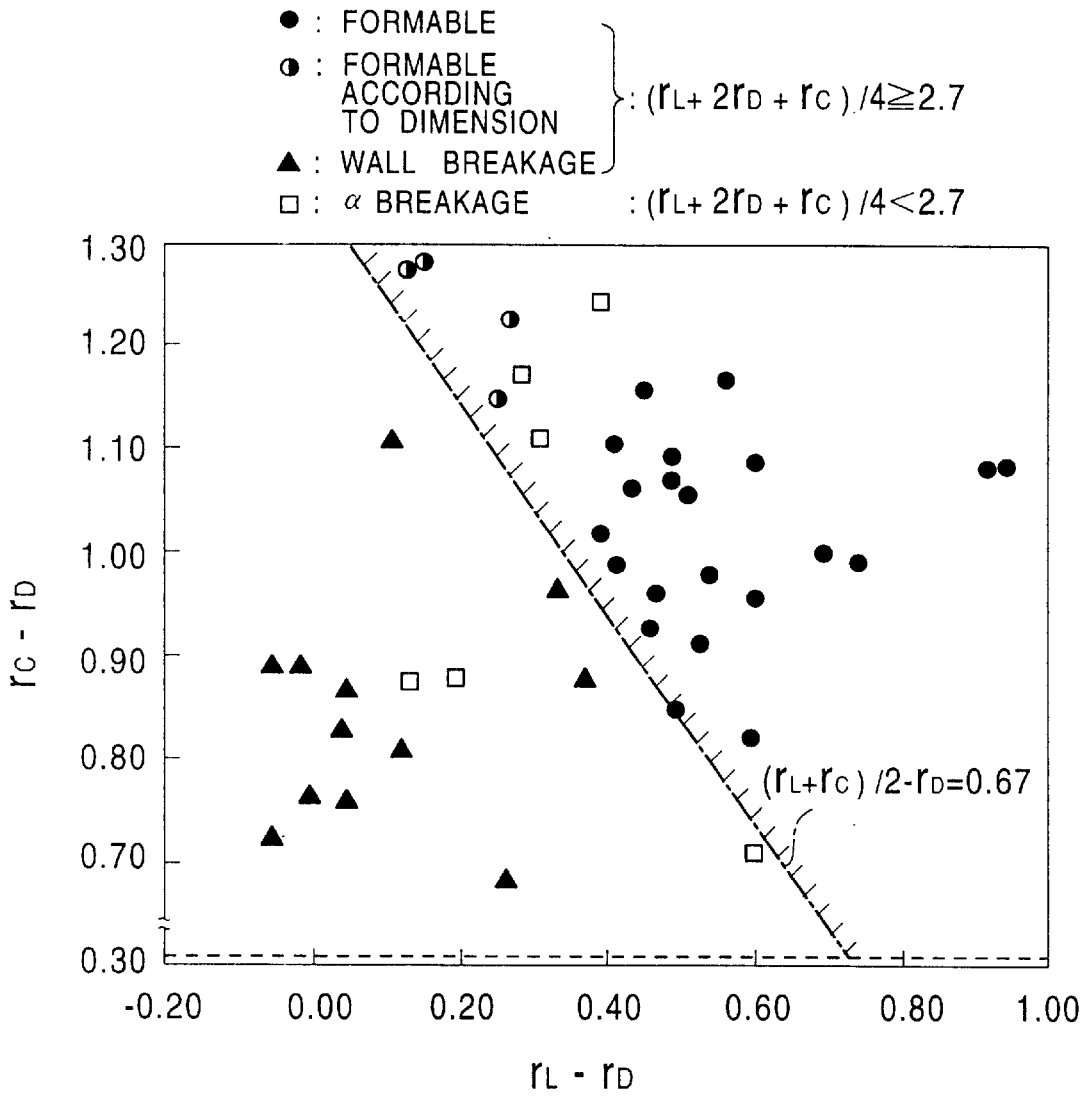
FIG. 8 is a drawing showing influences of $r_L$, $r_D$ and $r_C$ on rectangular drawability.

FIG. 8 shows the results of rectangular drawing tests for steel sheets in which $r_L$, $r_D$ and $r_C$ were changed by changing production conditions. FIG. 8 indicates that in order to obtain good rectangular drawability without defects, the conditions $(r_L+r_C)/2-r_D\geqq 0.67$ and $(r_L+2r_D+r_C)/4\geqq 2.7$ must be satisfied. In FIG. 8, the data of the examples shown in Tables 4 and 5 are summarized.

The inventors performed further investigation, and found that in addition to the above conditions, if at least one of the relations $r_L-r_D\geqq 0.3$ and $r_C-r_D\geqq 0.3$ is satisfied, rectangular formability is improved. These relations are found from FIG. 8. It was also confirmed that in rectangular drawing using the steel sheet, if the rectangular plane shape and the r values of the thin steel sheet are adjusted to satisfy the relations below, formability is further improved.

Namely, when the length a straight side of the rectangular shape in the rolling direction is $L_L$, and the length of a straight side of the rectangular shape in the direction perpendicular to the rolling direction is $L_C$, on the basis of the relation between $L_L$ and $L_C$, the following equations are established.

(1) When $L_L\geqq L_C$, $$r_C-r_D\geqq 0.3,\ \text{and}\ r_L-r_D\geqq 0.4-0.1(L_L/L_C) \tag{2}$$

When $L_L<L_C$, $$r_L-r_D\geqq 0.3,\ \text{and}\ r_C-r_D\geqq 0.4-0.1(L_C/L_L)^2$$

Figure 9A:
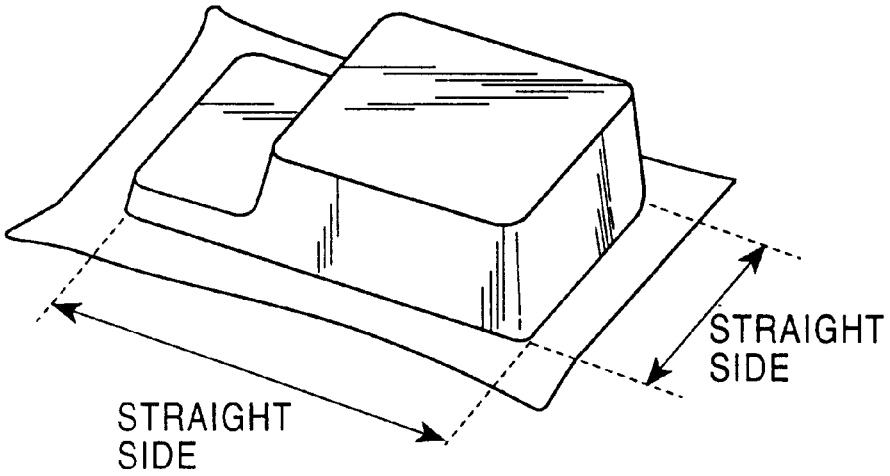
FIG. 9A is a drawing showing an example having a difference in height which is seen in a side view.
Figure 9B:
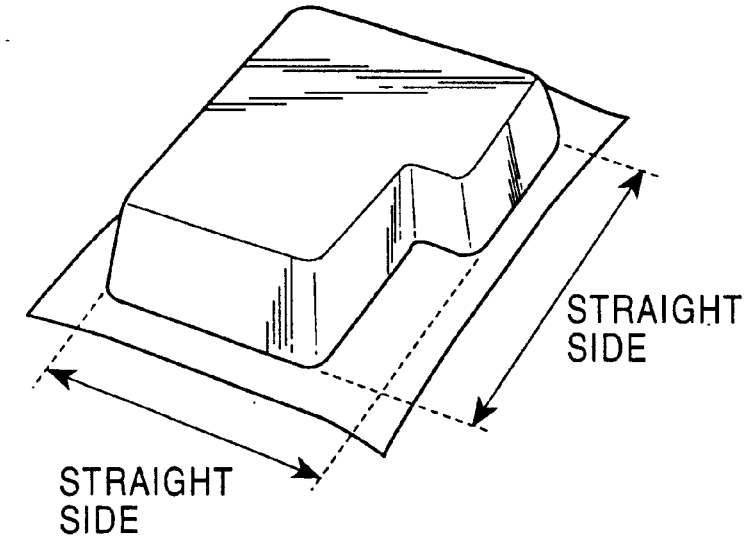
FIG. 9B is a drawing showing an example having a convex portion which is seen in a plan view.

Here, the length of a straight side of the rectangular shape means the length of a straight side of a rectangular plane shape. However, actual rectangular products hardly have simple three-dimensional shapes, and often have various complicated shapes such as the shape shown in FIG. 9A in which a difference in height is seen as viewed from a side thereof, the shape shown in FIG. 9B in which a convex portion is seen as viewed from a plane thereof, etc. In such cases, the length of a straight side means the maximum length of each of a short side and long side, as shown in FIG. 9.

The reasons why the relations of the r values depend upon the lengths of the straight sides, as shown by the above equations (1) and (2), are possibly that in rectangular drawing, the inflow peculiar to a rectangular shape is governed by the material in the direction of the long side, and thus even if the inflow of the short side is low, forming can be sufficiently carried out. At this time, the forming allowance for the length ratio of the straight sides was found to be affected by the second power of the length ratio $L_L/L_C$ or $L_C/L_L$.

The production conditions necessary for satisfying the above relations between the respective r values will be described below except the above-mentioned hot rolled sheet annealing conditions.

Slab reheating

The heating temperature for hot rolling is preferably in the range of 900 to 1200° C. After heating, hot-rolling comprising rough rolling and finishing rolling by multi-pass rolling is carried out. At this time, rough rolling and finishing rolling must be carried out in consideration of the following:

Roughing rolling

In order to increase the average r value of a cold-rolled and annealed steel sheet, it is necessary that the {111} texture is developed after hot-rolling and hot rolled sheet annealing. Therefore, it is important that the texture before finishing rolling is made fine and uniform in rough rolling, a large quantity of strain is uniformly accumulated in the steel sheet in subsequent finishing rolling, and the {111} texture is preferentially formed in annealing.

In order to make the texture before finishing rolling fine and uniform, it is necessary that roughing rolling is completed at 950° C. to the $Ar_3$ transformation point to produce $\gamma \rightarrow \alpha$ transformation immediately before finishing rolling. The roughing rolling is preferably completed just above the $Ar_3$ transformation point. On the other hand, if the end temperature of roughing rolling exceeds 950° C., the texture before finishing hot-rolling becomes coarse and nonuniform due to the occurrence of recovery and grain growth in the course of cooling to the $Ar_3$ transformation point where $\gamma \rightarrow \alpha$ transformation occurs. Therefore, the finishing temperature of roughing rolling is in the range of 950° C. to the $Ar_3$ transformation point. The reduction of roughing rolling is preferably 50% or more in order to make fine microstructure.

Finishing rolling

Finishing rolling must be carried out at the $Ar_3$ transformation point or less and a reduction of over 70%, preferably 80% or more, in order to accumulate a large amount of strain in finishing rolling. If finishing rolling is performed at a temperature over the $Ar_3$ transformation point, strain is released due to the occurrence of $\gamma \rightarrow \alpha$ transformation during hot-rolling, and the rolled texture is made random, thereby interfering with preferential formation of the {111} texture in annealing. On the other hand, finishing rolling at a temperature of less than 500° C. causes a significant increase in rolling load, and is thus unpractical. During finishing rolling at a total reduction of less than 70%, the {111} texture is not developed after hot-rolling and hot rolled sheet annealing.

Therefore, the finishing rolling conditions include a temperature of the $Ar_3$ transformation point to 500° C., preferably the $Ar_3$ transformation point to 600° C., and a reduction of over 70%, preferably 80% or more.

In the finishing rolling, lubrication is required for uniformly accumulating a large amount of strain during rolling. This is because without lubrication, additional shearing force acts on the surface layer of the steel sheet due to the frictional force between a roll and the surface of the steel sheet, and a texture other than the {111} texture is developed after hot-rolling and annealing, thereby decreasing the average r value of the cold-rolled and annealed steel sheet.

An example of the lubrication method is a method in which graphite, low-melting-point glass, mineral oil, or the like is adhered to the roll or the steel sheet by spraying or coating. This can decrease the friction coefficient between the roll and the steel sheet to 0.15 or less.

Cold rolling reduction

Cold rolling is essential for developing the texture to obtain a high average r value and high $\Delta r$, and the reduction of cold rolling is within the range of 50 to 95%. With a cold rolling reduction of less than 50% or over 95%, good properties cannot be obtained.

Finishing annealing

The cold-rolled steel sheet passed through the cold rolling step must be subjected to finishing annealing for recrystallization. The annealing process may be a box annealing process or a continuous annealing process. The heating temperature of annealing is preferably within the range of the recrystallization temperature (about 600° C.) to 950° C.

After annealing, the steel strip may be subjected to temper rolling for correcting the shape, adjusting the surface roughness, etc.

Further, the steel sheet obtained in the present invention can be used as an original sheet for a surface-treated steel sheet for working. In this case, the surface of the steel sheet is treated by a normal method such as galvanization (including alloy systems), tinning, enameling, or the like.

Next the composition of steel suitable for application to the present invention will be described.

C: 0.02 wt % or less

The C content is preferably as low as possible from the viewpoint of rectangular drawability. At a content of over 0.02 wt %, a large amount of cementite is precipitated in the hot-rolled steel sheet, thereby deceasing the r values after cold rolling and annealing. Therefore, the C content is 0.02 wt % or less, preferably 0.008% or less.

Si: 0.5 wt % or less

Si has the function to strengthen steel, and is added in a necessary amount according to desired strength. If the amount of Si added exceeds 0.5 wt %, rectangular drawability is adversely affected. Therefore, the Si content is in the range of 0.5 wt % or less.

Mn: 1.0 wt % or less

Mn has the function to strengthen steel, and is added in a necessary amount according to desired strength. If the amount of Mn added exceeds 1.0 wt %, the hardness of the hot-rolled steel sheet is rapidly increased, and elongation and the r values after cold rolling and annealing are decreased, thereby adversely affecting rectangular drawability. Therefore, the Mn content is in the range of 1.0 wt % or less.

P: 0.15 wt % or less

P has the function to strengthen steel, and is added in a necessary amount according to desired strength. If the amount of P added exceeds 0.15 wt %, large amounts of phosphides are precipitated in the hot-rolled steel sheet due to composite addition of Ti and Nb, thereby adversely affecting rectangular drawability after cold rolling and annealing. Therefore, the P content is 0.15 wt %.

S: 0.02 wt % or less

Since sulphides such as MnS, TiS, and the like decrease the r values and elongation, the S content is preferably as low as possible from the viewpoint of rectangular drawability. A S content of up to 0.02 wt % is allowable, and thus the S content is 0.02 wt % or less.

Al: 0.01 to 0.10 wt %

Al is added for deoxidation for improving the yield of a carbide and/or nitride forming element according to demand. Addition off less than 0.010 wt % of A has no effect, while addition of over 0.01 wt % of Al produces no further deoxidation effect. Therefore, the Al content is in the range of 0.01 to 0.10 wt %.

N: 0.008 wt % or less

N is dissolved to decrease aging, and solute nitrogen decreases the r values after cold rolling and annealing. The N content is preferably as low as possible from the viewpoint of rectangular drawability. Since a N content of up to 0.008 wt % is allowable, the N content is 0.008 wt % or less.

Ti: 0.001 to 0.20 wt %

Ti is a carbide and/or nitride forming element, and has the function to decrease solute C and N in steel before finishing rolling and cold rolling to preferentially form the {111} texture in the annealing step after finishing rolling and cold rolling. Ti is added for increasing the average r value. Addition of less than 0.01 wt % of Ti has no effect. On the other hand, if over 0.20 wt % of Ti is added, no further effect can be expected, and deterioration in surface quality results. Therefore, the amount of Ti added is 0.001 to 0.20 wt %, preferably 0.005 to 0.20 wt %, more preferably 0.035 to 0.10 wt %.

Nb: 0.001 to 0.15 wt %

Like Ti, Nb is a carbide and/or nitride forming element, and has the function to decrease solute C and N in steel before finishing rolling and cold rolling to preferentially form the {111} texture in the annealing step after finishing rolling and cold rolling. Nb also has the function to make fine microstructure before finishing hot-rolling to preferentially form the {111} texture during finishing rolling and annealing, and the function to increase the r values. Further solute Nb has the stain accumulating effect during finishing hot-rolling, and has the function to accelerate development of the texture. Addition of less than 0.001 wt % of Nb does not have the above effects. On the other hand, if over 0.15 wt % of Nb is added, no further effect can be expected, and a disadvantage brings about in which the recrystallization temperature is increased. Therefore, the amount of Nb added is in the range of 0.001 to 0.15 wt %, preferably 0.005 to 0.10 wt %.

B: 0.0001 to 0.01 wt %

B is an element effective for improving the resistance to secondary work embrittlement, and is added according to demand. Addition of less than 0.0001 wt % of B has no effect. On the other hand, addition of over 0.01 wt % of B causes deterioration in rectangular drawability. Therefore, the amount of B added is in the range of 0.0001 to 0.01 wt %, preferably 0.0001 to 0.005 wt %.

Sb: 0.001 to 0.05 wt %, Bi: 0.001 to 0.05 wt %, Se: 0.001 to 0.05 wt %

These elements have the effective function to suppress oxidation and nitriding in the slab reheating step and the hot rolled sheet annealing step, and are added according to demand. For all of these elements, addition of less than 0.001 wt % of element has no effect. On the other hand, addition of over 0.05 wt % of element causes deterioration in rectangular drawability. Therefore, the contents of these elements added are in the range of 0.001 to 0.05 wt %.

$1.2(C/12+N/14+S/32)<(Ti/48+Nb/93)$

If solute C and N are absent before finishing hot rolling, the {111} texture is developed after finishing hot rolling and hot rolled sheet annealing. The {111} texture is further developed by subsequent cold rolling and finishing annealing to improve the average r value. In the present invention, it was confirmed that in order to prevent the presence of solute C and N before finishing hot rolling, the amounts of Ti and Nb added may be adjusted to satisfy the relation $1.2(C/12+N/14+S/32)<(Ti/48+Nb/93)$.

EXAMPLES

A steel slab having a thickness of 250 mm and each of the chemical compositions shown in Table 1 was heated and soaked, and then roughly rolled (total reduction 85%) by a 3-stand roughing rolling mill under the conditions shown in Table 2 and Table 3, followed by finishing rolling by a 7-stand finishing rolling mill, pickling, hot rolled sheet annealing, cold rolling and finishing annealing. The cold-rolled and annealed steel sheets obtained were subjected to r value and rectangular drawability tests. The results of the tests are shown in Table 4 and 5.

The r values were measured by a three-point method after pre-tension strain of 15% had been applied to a tension test piece of JIS No. 5.

In the rectangular drawability test, rectangular test pieces of (a) 88 mm×88 mm, (b) 80×96 and (c) 76 mm by 104 mm were obtained from each of the steel sheets, and rustproofing oil was coated on the test pieces. Each of the test pieces was then set in a direction in which the corners of the test piece agreed with the corners of a rectangular punch, and drawn to a forming height of 30 mm under a blank holder pressure of 4 ton. The punches respectively had shapes of (a) 40 mm×40 mm (length ratio 1:1), (b) 32×48 (length ratio 1:1.5), and (b) 28 mm×56 mm (length ratio 1:2). On the basis of the results obtained, evaluation was made as to whether the test piece was formable (O) or not (x). When breakage occurred, a breakage (α) and wall breakage (W) were discriminated.

It was found that all steel sheets of the present invention satisfying each of the conditional equations for the r values have excellent rectangular drawability. On the other hand, in comparative examples, breakage of either α breakage or wall breakage occurred during rectangular drawing, and formability was insufficient.

Also, if the reduction of lubricated rolling in the temperature region of $Ar_3$ to 500° C. was 80% or more, both relations of $r_C-r_D \geqq 0.3$, and $r_L-r_D \geqq 0.3$ could be satisfied, and forming can be performed by rectangular drawing regardless of the plane shape.

On the other hand, at a reduction of 70% or more, $r_C-r_D \geqq 0.3$ and $r_L-r_D$ changed according to the reduction. In this case, if a plane shape was selected according to $r_L-r_D$, no problem occurred in rectangular drawability.

Industrial Applicability

The present invention provides a thin steel sheet having excellent rectangular drawability, particularly a thin steel sheet in which the occurrence of wall breakage during rectangular drawing is suppressed, and a production process thereof. The present invention also provides a method of application of a thin steel sheet which produces no breakage during rectangular drawing to various plane shapes (the shapes of products in plan views) using the thin steel sheet of the present invention and which is suitable for these shapes.

The present invention permits achievement of excellent rectangular drawability. It is thus possible to easily produce, by press forming, a rectangular component having a high forming height, such as an automobile oil pan, which has conventionally been produced by welding and assembling formed parts. Therefore, it is possible to simplify the production process, improve productivity and significantly decrease cost.

TABLE 1

| Steel | Chemical Component (wt %) | | | | | | | | | | | | | | |
|---|---|---|---|---|---|---|---|---|---|---|---|---|---|---|---|
| No. | C | Si | Mn | P | S | Al | N | Ti | Nb | B | Sb | Bi | Se | Equation | $Ar_3$ (° C.) |
| 1 | 0.0020 | 0.010 | 0.121 | 0.010 | 0.005 | 0.049 | 0.0020 | 0.070 | 0.015 | 0.0004 | 0.0090 | trace | trace | Satisfied | 910 |
| 2 | 0.0010 | 0.010 | 0.113 | 0.010 | 0.005 | 0.051 | 0.0021 | 0.068 | 0.014 | 0.0004 | 0.0090 | trace | trace | Satisfied | 910 |
| 3 | 0.0010 | 0.010 | 0.125 | 0.010 | 0.005 | 0.020 | 0.0019 | 0.068 | 0.015 | 0.0004 | trace | trace | trace | Satisfied | 915 |
| 4 | 0.0010 | 0.010 | 0.120 | 0.010 | 0.002 | 0.051 | 0.0019 | 0.069 | 0.014 | 0.0004 | 0.0090 | trace | trace | Satisfied | 910 |
| 5 | 0.0010 | 0.011 | 0.113 | 0.005 | 0.005 | 0.053 | 0.0020 | 0.073 | 0.014 | trace | 0.0090 | trace | trace | Satisfied | 915 |
| 6 | 0.0010 | 0.011 | 0.125 | 0.005 | 0.002 | 0.020 | 0.0019 | 0.068 | 0.015 | trace | trace | 0.0010 | 0.0010 | Satisfied | 920 |
| 7 | 0.03 | 0.010 | 0.124 | 0.011 | 0.005 | 0.051 | 0.0021 | 0.014 | 0.016 | 0.0004 | 0.0090 | trace | trace | Unsatisfied | 910 |
| 8 | 0.025 | 0.011 | 0.119 | 0.010 | 0.005 | 0.048 | 0.0019 | trace | 0.250 | 0.0004 | 0.0090 | trace | trace | Unsatisfied | 910 |

TABLE 1-continued

| Steel | Chemical Component (wt %) | | | | | | | | | | | | | | |
|---|---|---|---|---|---|---|---|---|---|---|---|---|---|---|---|
| No. | C | Si | Mn | P | S | Al | N | Ti | Nb | B | Sb | Bi | Se | Equation | $Ar_3$ (° C.) |
| 9 | 0.0019 | 0.010 | 0.116 | 0.009 | 0.005 | 0.048 | 0.0020 | 0.015 | 0.001 | 0.0004 | 0.0090 | trace | trace | Unsatisfied | 910 |
| 10 | 0.0010 | 0.010 | 0.120 | 0.007 | 0.005 | 0.050 | 0.0022 | 0.070 | trace | trace | 0.0090 | trace | trace | Satisfied | 910 |
| 11 | 0.0009 | 0.010 | 0.120 | 0.007 | 0.001 | 0.043 | 0.0010 | trace | 0.020 | trace | trace | trace | trace | Satisfied | 910 |
| 12 | 0.0012 | 0.010 | 0.121 | 0.010 | 0.005 | 0.049 | 0.0020 | 0.070 | 0.015 | 0.0004 | 0.0090 | trace | trace | Satisfied | 910 |
| 13 | 0.0010 | 0.010 | 0.125 | 0.010 | 0.005 | 0.020 | 0.0019 | 0.035 | 0.016 | 0.0004 | trace | trace | trace | Satisfied | 915 |
| 14 | 0.0010 | 0.011 | 0.113 | 0.005 | 0.005 | 0.053 | 0.0020 | 0.073 | 0.014 | trace | 0.0090 | trace | trace | Satisfied | 915 |
| 15 | 0.0010 | 0.011 | 0.125 | 0.005 | 0.002 | 0.020 | 0.0019 | 0.040 | 0.002 | trace | trace | trace | trace | Satisfied | 920 |
| 16 | 0.0020 | 0.011 | 0.119 | 0.010 | 0.005 | 0.048 | 0.0019 | 0.001 | 0.001 | 0.0004 | 0.0090 | trace | trace | Unsatisfied | 910 |
| 17 | 0.0020 | 0.400 | 0.121 | 0.040 | 0.005 | 0.049 | 0.0020 | 0.070 | 0.015 | 0.0004 | 0.0090 | trace | trace | Satisfied | 910 |
| 18 | 0.0020 | 0.800 | 0.8 | 0.080 | 0.005 | 0.049 | 0.0020 | 0.070 | 0.015 | 0.0004 | 0.0090 | trace | trace | Unsatisfied | 910 |
| 19 | 0.0020 | 0.010 | 2.000 | 0.010 | 0.005 | 0.049 | 0.0020 | 0.070 | 0.015 | 0.0004 | 0.0090 | trace | trace | Unsatisfied | 910 |
| 20 | 0.0020 | 0.200 | 0.5 | 0.080 | 0.005 | 0.049 | 0.0020 | 0.070 | 0.015 | 0.0004 | 0.0090 | trace | trace | Satisfied | 910 |
| 21 | 0.0020 | 0.010 | 0.121 | 0.200 | 0.005 | 0.049 | 0.0020 | 0.070 | 0.015 | 0.0004 | 0.0090 | trace | trace | Unsatisfied | 910 |
| 22 | 0.0020 | 0.300 | 0.8 | 0.040 | 0.005 | 0.049 | 0.0020 | 0.070 | 0.015 | 0.0004 | 0.0090 | trace | trace | Satisfied | 910 |

TABLE 2

| Experiment No. | Steel No. | Slab reheating temp. (° C.) | Rough hot-rolling end temp. (° C.) | Finishing rolling: Reduction at Ar3 to 500° C. (%) | Finishing rolling: Start temp. (° C.) | Finishing rolling: Finish temp. (° C.) | Lubrication |
|---|---|---|---|---|---|---|---|
| 1 | 1 | 1000 | 910 | 87 | 770 | 630 | Present |
| 2 | 1 | 1000 | 910 | 87 | 770 | 630 | Present |
| 3 | 1 | 1000 | 910 | 87 | 770 | 630 | Present |
| 4 | 1 | 1000 | 910 | 87 | 770 | 630 | Present |
| 5 | 1 | 1000 | 910 | 87 | 770 | 630 | Present |
| 6 | 1 | 1000 | 910 | 87 | 770 | 630 | Present |
| 7 | 1 | 1000 | 910 | 87 | 770 | 630 | Present |
| 8 | 1 | 1000 | 910 | 87 | 770 | 630 | Present |
| 9 | 1 | 1000 | 910 | 87 | 770 | 630 | Present |
| 10 | 1 | 1000 | 910 | 87 | 770 | 630 | Present |
| 11 | 1 | 1000 | 910 | 87 | 770 | 630 | Present |
| 12 | 1 | 1000 | 910 | 87 | 770 | 630 | Present |
| 13 | 1 | 1000 | 910 | 87 | 770 | 630 | Present |
| 14 | 1 | 1000 | 910 | 87 | 770 | 630 | Present |
| 15 | 1 | 1000 | 910 | 87 | 770 | 630 | Present |
| 16 | 1 | 1000 | 910 | 87 | 770 | 630 | Present |
| 17 | 1 | 1000 | 910 | 87 | 770 | 630 | Present |
| 18 | 1 | 1000 | 910 | 87 | 770 | 630 | Absent |
| 19 | 2 | 1020 | 920 | 80 | 880 | 600 | Present |
| 20 | 3 | 1020 | 930 | 80 | 900 | 600 | Present |
| 21 | 4 | 1020 | 920 | 84 | 880 | 700 | Present |
| 22 | 5 | 1050 | 930 | 84 | 900 | 700 | Present |
| 23 | 6 | 1100 | 950 | 90 | 900 | 700 | Present |
| 24 | 7 | 1000 | 910 | 87 | 770 | 650 | Present |
| 25 | 8 | 1000 | 910 | 87 | 770 | 650 | Present |
| 26 | 9 | 1000 | 820 | 87 | 780 | 650 | Present |
| 27 | 10 | 980 | 915 | 90 | 770 | 630 | Present |
| 28 | 11 | 980 | 915 | 87 | 770 | 630 | Present |
| 29 | 1 | 1000 | 960 | 87 | 770 | 630 | Present |
| 30 | 1 | 1000 | 915 | 70 | 820 | 700 | Present |

| Experiment No. | Hot rolled sheet annealing: Coiling temp. (° C.) | Hot rolled sheet annealing: Temp. (° C.) | Hot rolled sheet annealing: Time (sec.) | Hot rolled sheet annealing: (T + 273) (20 + log t) *$10^4$ | Cold rolling: Reduction (%) | Cold rolling: Thickness (mm) | Finish Annealing: Temp. (° C.) | Finish Annealing: Time |
|---|---|---|---|---|---|---|---|---|
| 1 | 550 | 750 | 18000 | 2.48 | 76 | 1.20 | 910 | 40 s |
| 2 | 550 | 750 | 18000 | 2.48 | 80 | 1.00 | 910 | 40 s |
| 3 | 550 | 750 | 18000 | 2.48 | 85 | 0.85 | 910 | 40 s |
| 4 | 550 | 800 | 18000 | 2.60 | 76 | 1.20 | 910 | 40 s |
| 5 | 550 | 800 | 18000 | 2.60 | 80 | 1.00 | 910 | 40 s |
| 6 | 550 | 800 | 18000 | 2.60 | 85 | 0.85 | 910 | 40 s |
| 7 | 550 | 850 | 18000 | 2.72 | 76 | 1.20 | 910 | 40 s |
| 8 | 550 | 850 | 18000 | 2.72 | 80 | 1.00 | 910 | 40 s |
| 9 | 550 | 850 | 18000 | 2.72 | 85 | 0.85 | 910 | 40 s |
| 10 | 550 | 750 | 3600 | 2.41 | 80 | 1.00 | 910 | 40 s |
| 11 | 550 | 790 | 3600 | 2.50 | 80 | 1.00 | 910 | 40 s |
| 12 | 550 | 850 | 3600 | 2.65 | 80 | 1.00 | 910 | 40 s |
| 13 | 550 | 900 | 40 | 2.53 | 80 | 1.00 | 910 | 40 s |
| 14 | 550 | 800 | 60 | 2.34 | 80 | 1.00 | 910 | 40 s |
| 15 | 550 | 830 | 60 | 2.40 | 80 | 1.00 | 910 | 40 s |
| 16 | 550 | 850 | 40 | 2.43 | 80 | 1.00 | 910 | 40 s |
| 17 | 550 | 890 | 20 | 2.48 | 80 | 1.00 | 910 | 40 s |
| 18 | 550 | 800 | 18000 | 2.60 | 76 | 1.20 | 910 | 40 s |
| 19 | 600 | 800 | 18000 | 2.60 | 80 | 0.80 | 880 | 40 s |
| 20 | 600 | 800 | 18000 | 2.60 | 80 | 0.80 | 880 | 40 s |
| 21 | 600 | 800 | 18000 | 2.60 | 80 | 0.80 | 880 | 40 s |
| 22 | 600 | 800 | 18000 | 2.60 | 80 | 0.80 | 880 | 40 s |
| 23 | 600 | 800 | 18000 | 2.60 | 80 | 0.80 | 800 | 5 h |
| 24 | 580 | 800 | 18000 | 2.60 | 80 | 0.80 | 800 | 5 h |
| 25 | 580 | 800 | 18000 | 2.60 | 80 | 0.80 | 800 | 5 h |
| 26 | 580 | 800 | 18000 | 2.60 | 80 | 0.80 | 800 | 5 h |
| 27 | 580 | 800 | 18000 | 2.60 | 80 | 0.80 | 900 | 40 s |
| 28 | 580 | 800 | 18000 | 2.60 | 80 | 0.80 | 900 | 40 s |
| 29 | 580 | 800 | 18000 | 2.60 | 80 | 1.00 | 910 | 40 s |
| 30 | 580 | 800 | 18000 | 2.60 | 80 | 1.00 | 910 | 40 s |

TABLE 3

| Experiment No. | Steel No. | Slab reheating temp. (° C.) | Rough hot-rolling end temp. (° C.) | Finishing rolling: Reduction at Ar3 to 500° C. (%) | Finishing rolling: Start temp. (° C.) | Finishing rolling: Finish temp. (° C.) | Lubrication |
|---|---|---|---|---|---|---|---|
| 31 | 12 | 1000 | 910 | 72 | 770 | 630 | Present |
| 32 | 12 | 1000 | 910 | 84 | 770 | 630 | Present |
| 33 | 12 | 1000 | 910 | 84 | 770 | 630 | Present |
| 34 | 12 | 1000 | 910 | 84 | 770 | 630 | Present |
| 35 | 12 | 1000 | 910 | 84 | 770 | 630 | Present |
| 36 | 12 | 1000 | 910 | 75 | 880 | 775 | Present |
| 37 | 12 | 1020 | 950 | 84 | 880 | 750 | Absent |
| 38 | 12 | 1020 | 950 | 84 | 880 | 800 | Absent |
| 39 | 13 | 1020 | 920 | 84 | 760 | 600 | Present |
| 40 | 14 | 1020 | 930 | 84 | 750 | 600 | Present |
| 41 | 15 | 1020 | 940 | 84 | 760 | 620 | Present |
| 42 | 16 | 1000 | 910 | 87 | 770 | 650 | Prcscnt |
| 43 | 12 | 1000 | 910 | 72 | 770 | 630 | Present |
| 44 | 12 | 1000 | 910 | 76 | 770 | 630 | Present |
| 45 | 12 | 1000 | 910 | 80 | 770 | 630 | Present |
| 46 | 9 | 1000 | 930 | 85 | 800 | 630 | Present |
| 47 | 17 | 1000 | 910 | 87 | 770 | 630 | Present |
| 48 | 18 | 1000 | 910 | 87 | 770 | 630 | Present |
| 49 | 19 | 1000 | 910 | 87 | 770 | 630 | Present |
| 50 | 20 | 1000 | 910 | 87 | 770 | 630 | Present |
| 51 | 21 | 1000 | 910 | 87 | 770 | 630 | Present |
| 52 | 22 | 1000 | 910 | 87 | 770 | 630 | Present |

| Experiment No. | Hot rolled sheet annealing: Coiling temp. (° C.) | Hot rolled sheet annealing: Temp. (° C.) | Hot rolled sheet annealing: Time (sec.) | Hot rolled sheet annealing: (T + 273)(20 + log t) *$10^4$ | Cold rolling: Reduction (%) | Cold rolling: Thickness (mm) | Finish Annealing: Temp. (° C.) | Finish Annealing: Time |
|---|---|---|---|---|---|---|---|---|
| 31 | 580 | 800 | 18000 | 2.60 | 80 | 1.20 | 910 | 40 s |
| 32 | 550 | 750 | 360 | 2.31 | 85 | 0.85 | 910 | 40 s |
| 33 | 550 | 850 | 18000 | 2.72 | 85 | 0.85 | 910 | 40 s |
| 34 | 550 | 900 | 36000 | 2.88 | 85 | 0.85 | 910 | 40 s |
| 35 | 550 | 850 | 18000 | 2.72 | 80 | 1.00 | 910 | 40 s |
| 36 | 700 | 800 | 36000 | 2.60 | 80 | 1.00 | 910 | 40 s |
| 37 | 500 | 800 | 18000 | 2.60 | 76 | 1.20 | 910 | 40 s |
| 38 | 700 | 850 | 36000 | 2.76 | 76 | 1.20 | 850 | 41 s |
| 39 | 550 | 800 | 18000 | 2.60 | 80 | 0.80 | 880 | 40 s |
| 40 | 550 | 800 | 18000 | 2.60 | 80 | 0.80 | 880 | 40 s |
| 41 | 550 | 800 | 18000 | 2.60 | 80 | 0.80 | 880 | 40 s |
| 42 | 580 | 800 | 18000 | 2.60 | 80 | 0.80 | 880 | 5 h |
| 43 | 550 | 800 | 18000 | 2.60 | 80 | 0.80 | 880 | 40 s |
| 44 | 550 | 800 | 18000 | 2.60 | 80 | 0.80 | 880 | 40 s |
| 45 | 550 | 800 | 18000 | 2.60 | 80 | 0.80 | 880 | 40 s |
| 46 | 550 | 800 | 18000 | 2.60 | 80 | 0.80 | 800 | 5 h |
| 47 | 550 | 800 | 18000 | 2.60 | 85 | 0.85 | 910 | 40 s |
| 48 | 550 | 800 | 18000 | 2.60 | 85 | 0.85 | 910 | 40 s |
| 49 | 550 | 800 | 18000 | 2.60 | 85 | 0.85 | 910 | 40 s |
| 50 | 550 | 800 | 18000 | 2.60 | 85 | 0.85 | 910 | 40 s |
| 51 | 550 | 800 | 18000 | 2.60 | 85 | 0.85 | 910 | 40 s |
| 52 | 550 | 800 | 18000 | 2.60 | 85 | 0.85 | 910 | 40 s |

TABLE 4

| Experiment No. | $r_L$ | $r_D$ | $r_C$ | $r_L - r_D$ | $r_D - r_L$ | Δr*1 | Average r value*2 | (L_L:L_C) Establishment of other equations and rectangular drawability*3: 1:2 | | 1:1.5 | | 1:1 | | 1.5:1 | | 2:1 | | Remark |
|---|---|---|---|---|---|---|---|---|---|---|---|---|---|---|---|---|---|---|
| 1 | 2.67 | 2.72 | 3.61 | −0.05 | 0.89 | 0.42 | 2.93 | — | xW | — | xW | — | xW | — | xW | — | xW | Comparative Example |
| 2 | 2.80 | 2.82 | 3.71 | −0.02 | 0.89 | 0.44 | 3.04 | — | xW | — | xW | — | xW | — | xW | — | xW | Comparative Example |
| 3 | 2.99 | 2.95 | 3.78 | 0.04 | 0.83 | 0.44 | 3.17 | — | xW | — | xW | — | xW | — | xW | — | xW | Comparative Example |
| 4 | 2.83 | 2.42 | 3.52 | 0.41 | 1.10 | 0.76 | 2.80 | Y | ○ | Y | ○ | Y | ○ | Y | ○ | Y | ○ | Invention Example |
| 5 | 3.01 | 2.62 | 3.64 | 0.39 | 1.02 | 0.71 | 2.97 | Y | ○ | Y | ○ | Y | ○ | Y | ○ | Y | ○ | Invention Example |

TABLE 4-continued

| Experiment No. | $r_L$ | $r_D$ | $r_C$ | $r_L - r_D$ | $r_D - r_L$ | $\Delta r^{*1}$ | Average r value*2 | ($L_L$:$L_C$) Establishment of other equations and rectangular drawability*3 1:2 | | 1:1.5 | | 1:1 | | 1.5:1 | | 2:1 | | Remark |
|---|---|---|---|---|---|---|---|---|---|---|---|---|---|---|---|---|---|---|
| 6 | 3.13 | 2.72 | 3.71 | 0.41 | 0.99 | 0.70 | 3.07 | Y | ○ | Y | ○ | Y | ○ | Y | ○ | Y | ○ | Invention Example |
| 7 | 3.00 | 2.29 | 3.29 | 0.71 | 1.00 | 0.86 | 2.72 | Y | ○ | Y | ○ | Y | ○ | Y | ○ | Y | ○ | Invention Example |
| 8 | 3.30 | 2.36 | 3.44 | 0.94 | 1.08 | 1.01 | 2.87 | Y | ○ | Y | ○ | Y | ○ | Y | ○ | Y | ○ | Invention Example |
| 9 | 3.40 | 2.79 | 3.61 | 0.61 | 0.82 | 0.72 | 3.15 | Y | ○ | Y | ○ | Y | ○ | Y | ○ | Y | ○ | Invention Example |
| 10 | 2.75 | 2.75 | 3.51 | 0.00 | 0.76 | 0.38 | 2.94 | — | xW | — | xW | — | xW | — | xW | — | xW | Comparative Example |
| 11 | 2.83 | 2.52 | 3.64 | 0.31 | 1.12 | 0.72 | 2.88 | Y | ○ | Y | ○ | Y | ○ | Y | ○ | Y | ○ | Invention Example |
| 12 | 3.21 | 2.45 | 3.44 | 0.76 | 0.99 | 0.88 | 2.89 | Y | ○ | Y | ○ | Y | ○ | Y | ○ | Y | ○ | Invention Example |
| 13 | 3.15 | 2.55 | 3.51 | 0.60 | 0.96 | 0.78 | 2.94 | Y | ○ | Y | ○ | Y | ○ | Y | ○ | Y | ○ | Invention Example |
| 14 | 2.65 | 2.70 | 3.42 | −0.05 | 0.72 | 0.34 | 2.87 | — | xW | — | xW | — | xW | — | xW | — | xW | Comparative Example |
| 15 | 2.70 | 2.66 | 3.42 | 0.04 | 0.76 | 0.40 | 2.86 | — | xW | — | xW | — | xW | — | xW | — | xW | Comparative Example |
| 16 | 2.74 | 2.62 | 3.43 | 0.12 | 0.81 | 0.47 | 2.85 | — | xW | — | xW | — | xW | — | xW | — | xW | Comparative Example |
| 17 | 2.78 | 2.44 | 3.41 | 0.34 | 0.97 | 0.66 | 2.77 | — | xW | — | xW | — | xW | — | xW | — | xW | Comparative Example |
| 18 | 2.58 | 2.38 | 3.26 | 0.20 | 0.88 | 0.54 | 2.65 | — | xα | — | xα | — | xα | — | xα | — | xα | Comparative Example |
| 19 | 3.23 | 2.74 | 3.81 | 0.49 | 1.07 | 0.78 | 3.13 | Y | ○ | Y | ○ | Y | ○ | Y | ○ | Y | ○ | Invention Example |
| 20 | 3.13 | 2.64 | 3.71 | 0.49 | 1.07 | 0.78 | 3.03 | Y | ○ | Y | ○ | Y | ○ | Y | ○ | Y | ○ | Invention Example |
| 21 | 3.21 | 2.75 | 3.68 | 0.46 | 0.93 | 0.70 | 3.10 | Y | ○ | Y | ○ | Y | ○ | Y | ○ | Y | ○ | Invention Example |
| 22 | 3.23 | 2.76 | 3.72 | 0.47 | 0.96 | 0.72 | 3.12 | Y | ○ | Y | ○ | Y | ○ | Y | ○ | Y | ○ | Invention Example |
| 23 | 3.24 | 2.81 | 3.87 | 0.43 | 1.06 | 0.75 | 3.18 | Y | ○ | Y | ○ | Y | ○ | Y | ○ | Y | ○ | Invention Example |
| 24 | 2.42 | 2.10 | 3.21 | 0.32 | 1.11 | 0.72 | 2.46 | — | xα | — | xα | — | xα | — | xα | — | xα | Comparative Example |
| 25 | 2.44 | 2.15 | 3.32 | 0.29 | 1.17 | 0.73 | 2.52 | — | xα | — | xα | — | xα | — | xα | — | xα | Comparative Example |
| 26 | 2.41 | 2.01 | 3.25 | 0.40 | 1.24 | 0.82 | 2.42 | — | xα | — | xα | — | xα | — | xα | — | xα | Comparative Example |
| 27 | 3.24 | 2.68 | 3.84 | 0.56 | 1.16 | 0.86 | 3.11 | Y | ○ | Y | ○ | Y | ○ | Y | ○ | Y | ○ | Invention Example |
| 28 | 3.27 | 2.74 | 3.72 | 0.53 | 0.98 | 0.76 | 3.12 | Y | ○ | Y | ○ | Y | ○ | Y | ○ | Y | ○ | Invention Example |
| 29 | 2.40 | 2.30 | 3.40 | 0.10 | 1.10 | 0.60 | 2.60 | — | xα | — | xα | — | xα | — | xα | — | xα | Comparative Example |
| 30 | 2.69 | 2.42 | 3.09 | 0.27 | 0.67 | 0.40 | 2.62 | — | xα | — | xα | — | xα | — | xα | — | xα | Comparative Example |

TABLE 5

| Experiment No. | $r_L$ | $r_D$ | $r_C$ | $r_L - r_D$ | $r_D - r_L$ | $\Delta r^{*1}$ | Average r value*2 | ($L_L$:$L_C$) Establishment of other equations and rectangular drawability*3 1:2 | | 1:1.5 | | 1:1 | | 1.5:1 | | 2:1 | | Remark |
|---|---|---|---|---|---|---|---|---|---|---|---|---|---|---|---|---|---|---|
| 31 | 2.67 | 2.55 | 3.82 | 0.12 | 1.27 | 0.70 | 2.90 | N | xW | N | xW | N | xW | N | xW | Y | ○ | Invention Example |
| 32 | 2.99 | 2.95 | 3.71 | 0.04 | 0.76 | 0.40 | 3.15 | — | xW | — | xW | — | xW | — | xW | — | xW | Comparative Example |
| 33 | 3.14 | 2.62 | 3.53 | 0.52 | 0.91 | 0.72 | 2.98 | Y | ○ | Y | ○ | Y | ○ | Y | ○ | Y | ○ | Invention Example |
| 34 | 2.90 | 2.52 | 3.40 | 0.38 | 0.88 | 0.63 | 2.84 | — | xW | — | xW | — | xW | — | xW | — | xW | Comparative Example |
| 35 | 3.32 | 2.36 | 3.44 | 0.96 | 1.08 | 1.02 | 2.87 | Y | ○ | Y | ○ | Y | ○ | Y | ○ | Y | ○ | Invention Example |
| 36 | 2.80 | 2.55 | 3.70 | 0.25 | 1.15 | 0.70 | 2.90 | Y | ○ | Y | ○ | Y | xW | N | xW | Y | ○ | Invention Example |
| 37 | 2.50 | 2.38 | 3.26 | 0.12 | 0.88 | 0.50 | 2.63 | — | xα | — | xα | — | xα | — | xα | — | xα | Comparative |

TABLE 5-continued

| Experiment No. | $r_L$ | $r_D$ | $r_C$ | $r_L - r_D$ | $r_D - r_L$ | Δr*1 | Average r value*2 | ($L_L$:$L_C$) Establishment of other equations and rectangular drawability*3 1:2 | | 1:1.5 | | 1:1 | | 1.5:1 | | 2:1 | | Remark |
|---|---|---|---|---|---|---|---|---|---|---|---|---|---|---|---|---|---|---|
| 38 | 2.80 | 2.20 | 2.90 | 0.60 | 0.70 | 0.65 | 2.53 | — | xα | — | xα | — | xα | — | xα | — | xα | Example Comparative Example |
| 39 | 3.20 | 2.70 | 3.75 | 0.50 | 1.05 | 0.78 | 3.05 | Y | ○ | Y | ○ | Y | ○ | Y | ○ | Y | ○ | Example Invention Example |
| 40 | 3.13 | 2.64 | 3.73 | 0.49 | 1.09 | 0.79 | 3.04 | Y | ○ | Y | ○ | Y | ○ | Y | ○ | Y | ○ | Example Invention Example |
| 41 | 3.21 | 2.60 | 3.80 | 0.61 | 1.08 | 0.85 | 3.02 | Y | ○ | Y | ○ | Y | ○ | Y | ○ | Y | ○ | Example Invention Example |
| 42 | 2.42 | 2.10 | 3.21 | 0.32 | 1.11 | 0.72 | 2.46 | — | xα | — | xα | — | xα | — | xα | — | xα | Example Comparative Example |
| 43 | 2.80 | 2.62 | 3.90 | 0.15 | 1.28 | 0.73 | 2.99 | N | xW | N | xW | N | xW | N | xW | Y | ○ | Example Invention Example |
| 44 | 2.90 | 2.63 | 3.85 | 0.27 | 1.22 | 0.75 | 3.00 | N | xW | N | xW | N | xW | Y | ○ | Y | ○ | Example Invention Example |
| 45 | 3.10 | 2.65 | 3.80 | 0.45 | 1.15 | 0.80 | 3.05 | Y | ○ | Y | ○ | Y | ○ | Y | ○ | Y | ○ | Example Invention Example |
| 46 | 2.89 | 2.39 | 3.23 | 0.50 | 0.84 | 0.67 | 2.73 | Y | ○ | Y | ○ | Y | ○ | Y | ○ | Y | ○ | Example Invention Example |
| 47 | 3.13 | 2.72 | 3.71 | 0.41 | −0.41 | 0.70 | 3.07 | Y | ○ | Y | ○ | Y | ○ | Y | ○ | Y | ○ | Example Invention Example |
| 48 | 2.40 | 2.35 | 3.08 | 0.05 | −0.05 | 0.39 | 2.55 | — | xα | — | xα | — | xα | — | xα | — | xα | Example Comparative Example |
| 49 | 2.21 | 2.45 | 2.95 | −0.24 | 0.24 | 0.13 | 2.52 | — | xα | — | xα | — | xα | — | xα | — | xα | Example Comparative Example |
| 50 | 2.95 | 2.55 | 3.62 | 0.40 | −0.40 | 0.74 | 2.92 | Y | ○ | Y | ○ | Y | ○ | Y | ○ | Y | ○ | Example Invention Example |
| 51 | 2.42 | 2.10 | 3.21 | 0.32 | −0.32 | 0.72 | 2.46 | — | xα | — | xα | — | xα | — | xα | — | xα | Example Comparative Example |
| 52 | 3.08 | 2.65 | 3.70 | 0.43 | −0.43 | 0.74 | 3.02 | Y | ○ | Y | ○ | Y | ○ | Y | ○ | Y | ○ | Example Invention Example |

When $L_L \geqq L_C$ $r_C - r_D \geqq 0.3$, and $r_L - r_D \geqq 0.4 - 0.1(L_L/L_C)^2$, or when $L_L < L_C$ $r_L - r_D \geqq 0.3$, and $r_C - r_D \geqq 0.4 - 0.1(L_C/L_L)^2$.

However, when the average r value <2.7 and Δr<0.67, no evaluation was made, which is simply shown by "–".

In the right column, rectangular drawability is shown, and accompanied characters "W" and "α" indicate wall breakage and α-breakage, respectively.

What is claimed is:

1. A steel sheet having excellent rectangular drawability wherein the Lankford value in each of the direction of the steel sheet satisfies the following relational equations:

$$(r_L + r_C)/2 - r_D \geqq 0.67; \text{ and}$$

$$(r_L + 2r_D + r_C)/4 \geqq 2.7;$$

wherein:

$r_L$: Lankford value in the rolling direction $r_D$: Lankford value in the direction at 45° with the rolling direction $r_C$: Lankford value in the direction perpendicular to the rolling direction.

2. A steel sheet having excellent rectangular drawability wherein the Lankford value in each of the directions of the steel sheet satisfies the following relational equations:

$$(r_L + r_C)/2 - r_D \geqq 0.67; \text{ and}$$

$$(r_L + 2r_D + r_C)/4 \geqq 2.7;$$

and at least one of the following relations:

$$r_C - r_D \geqq 0.3; \text{ and}$$

$$r_L - r_D \geqq 0.3;$$

wherein:

$r_L$: Lankford value in the rolling direction $r_D$: Lankford value in the direction at 45° with the rolling direction $r_C$: Lankford value in the direction perpendicular to the rolling direction.

3. The steel sheet according to claim 1 containing 0.02 wt % or less of C.

4. The steel sheet according to claim 1 comprising the following composition:

C: 0.02 wt % or less;

Si: 0.5 wt % or less;

Mn: 1.0 wt % or less;

P: 0.15 wt % or less;

S: 0.02 wt % or less;

Al: 0.01 to 0.10 wt %,

N: 0.008 wt % or less;

at least one of Ti: 0.001 to 0.20 wt % and Nb: 0.001 to 0.15 wt %;

the balance comprising Fe; and inevitable impurities.

5. The steel sheet according to claim 1 comprising the following composition:

C: 0.02 wt % or less;

Si: 0.5 wt % or less;

Mn: 1.0 wt % or less;

P: 0.15 wt % or less;

S: 0.02 wt % or less;

Al: 0.01 to 0.10 wt %;

N: 0.008 wt % or less;

at least one of Ti: 0.001 to 0.20 wt %, and Nb: 0.001 to 0.15 wt %;

B: 0.0001 to 0.01 wt %;

the balance comprising Fe; and inevitable impurities.

6. The steel sheet according to claim 1 comprising the following composition:

C: 0.02 wt % or less;

Si: 0.5 wt % or less;

Mn: 1.0 wt % or less;

P: 0.15 wt % or less;

S: 0.02 wt % or less;

Al: 0.01 to 0.10 wt %;

N: 0.008 wt % or less;

at least one of Ti: 0.001 to 0.20 wt %, and Nb: 0.001 to 0.15 wt %;

at least one of Sb: 0.001 to 0.05 wt %, Bi: 0.001 to 0.05 wt %, and Se: 0.001 to 0.05 wt %;

the balance comprising Fe; and inevitable impurities.

7. The steel sheet according to claim 1 comprising the following composition:

C: 0.02 wt % or less;

Si: 0.5 wt % or less;

Mn: 1.0 wt % or less;

P: 0.15 wt % or less;

S: 0.02 wt % or less;

Al: 0.01 to 0.10 wt %;

N: 0.008 wt % or less;

at least one of Ti: 0.001 to 0.20 wt %, and Nb: 0.001 to 0.15 wt %;

B: 0.0001 to 0.01 wt %;

at least one of Sb: 0.001 to 0.05 wt %, Bi: 0.001 to 0.05 wt %, and Se: 0.001 to 0.05 wt %;

the balance comprising Fe; and inevitable impurities.

8. The steel sheet according to claim 4, wherein the contents of C, N, S, Ti and Nb satisfy the following relation:

$$1.2(C/12+N/14+S/32)<(Ti/48+Nb/93).$$

9. A method of producing a steel sheet having excellent rectangular drawability, comprising completing roughing rolling of steel comprising the following composition in the temperature region of 950° C. to the $Ar_3$ transformation temperature:

C: 0.02 wt % or less;

Si: 0.5 wt % or less;

Mn: 1.0 wt % or less;

P: 0.15 wt % or less;

S: 0.02 wt % or less;

Al: 0.01 to 0.10 wt %;

N: 0.008 wt % or less;

at least one of Ti: 0.001 to 0.20 wt % and Nb: 0.001 to 0.15 wt %;

the balance comprising Fe; and inevitable impurities;

performing finish rolling at a reduction of over 70% under lubrication in the temperature region of the $Ar_3$ transformation temperature to 500° C.; pickling; performing hot rolled sheet annealing of the resultant hot rolled sheet under conditions which satisfy the equations (1) and (2) below; cold rolling at a reduction of 50 to 95%; and then recrystallization annealing:

$$(T+273)(20+\log t)\geqq 2.50\times 10^4 \quad (1)$$

$$745\leqq T\leqq 920 \quad (2)$$

wherein:

T: hot rolled sheet annealing temperature (° C.)

t: hot rolled sheet annealing time (sec).

10. The method of producing a steel sheet according to claim 9, wherein the steel composition further comprises:

B: 0.0001 to 0.01 wt %.

11. The method of producing a steel sheet according to claim 9, wherein the steel composition further comprises:

at least one of Sb: 0.001 to 0.05 wt %, Bi: 0.001 to 0.05 wt %, and Se: 0.001 to 0.05 wt %.

12. The method of producing a steel sheet according to claim 9, wherein the contents of C, N, S, Ti and Nb satisfy the following relation:

$$1.2(C/12+N/14+S/32)<(Ti/48+Nb/93).$$

13. A method of application of a steel sheet wherein in rectangular drawing using a steel sheet, a rectangular plane shape and the Lankford values of the steel sheet are adjusted to satisfy the following equations:

$$(r_L+r_C)/2-r_D\geqq 0.67;\text{ and}$$

$$(r_L+2r_D+r_C)/4\geqq 2.7;$$

when $L_L>L_C$, $$r_C-r_D\geqq 0.3;\text{ and}$$

$$r_L-r_D\geqq 0.4-0.1(L_L/L_C)^2;\text{ and}$$

when $L_L<L_C$, $$r_L-r_D\geqq 0.3;\text{ and}$$

$$r_L-r_D\geqq 0.4-0.1(L_C/L_L)^2;$$

wherein:

$L_L$: length of a straight side of a rectangular shape in the rolling direction $L_C$: length of a straight side of a rectangular shape in the direction perpendicular to the rolling direction $r_L$: Lankford value in the rolling direction $r_D$: Lankford value in the direction at 45° with the rolling direction $r_C$: Lankford value in the direction perpendicular to the rolling direction.

14. A method of forming a steel sheet wherein in rectangular drawing using a steel sheet, a rectangular plane shape and the Lankford values of the steel sheet are adjusted to satisfy the following equations:

$$(r_L+r_C)/2-r_D\geqq 0.67;\text{ and}$$

$$(r_L+2r_D+r_C)/4\geqq 2.7;$$

when $L_L>L_C$, $$r_C-r_D\geqq 0.3;\text{ and}$$

$$r_L-r_D\geqq 0.4-0.1(L_L/L_C)^2;\text{ and}$$

when $L_L<L_C$, $r_L - r_D \geqq 0.3$; and $r_C - r_D \geqq 0.4 - 0.1(L_C/L_L)^2$;

wherein:

$L_L$: length of a straight side of a rectangular shape in the rolling direction $L_C$: length of a straight side of a rectangular shape in the direction perpendicular to the rolling direction $r_L$: Lankford value in the rolling direction $r_D$: Lankford value in the direction at 45° with the rolling direction $r_C$: Lankford value in the direction perpendicular to the rolling direction.

* * * * *